United States Patent [19]

Kangle et al.

[11] 4,225,313

[45] Sep. 30, 1980

[54] DYEING AND PRINTING PROCESSES

[75] Inventors: Purushottam J. Kangle, Goregaon-Bombay, India; Branimir Milicevic, Riehen, Switzerland

[73] Assignee: Ciba-Geigy, AG, Basel, Switzerland

[21] Appl. No.: 532,965

[22] Filed: Dec. 16, 1974

Related U.S. Application Data

[63] Continuation of Ser. No. 402,244, Oct. 1, 1973, abandoned, which is a continuation of Ser. No. 222,664, Feb. 1, 1972, abandoned, which is a continuation of Ser. No. 819,964, Apr. 28, 1969, abandoned.

[30] Foreign Application Priority Data

May 10, 1968 [CH] Switzerland ..... 6998/68

[51] Int. Cl. ..... D06p 1/90

[52] U.S. Cl. ..... 8/474; 8/491; 8/614

[58] Field of Search ..... 8/176, 174, 175, 94, 8/169

[56] References Cited

U.S. PATENT DOCUMENTS

| | | | |
|---|---|---|---|
| 2,184,559 | 12/1939 | Mellor | 8/174 |
| 3,632,301 | 1/1972 | Maier-Windhorst | 8/93 |
| 3,667,898 | 6/1972 | Bergman et al. | 8/94 |
| 3,762,872 | 10/1973 | Acree | 8/94 |

FOREIGN PATENT DOCUMENTS

| | | | |
|---|---|---|---|
| 1542304 | 9/1968 | France | 8/DIG. 15 |
| 1083024 | 9/1967 | United Kingdom | 8/DIG. 15 |

OTHER PUBLICATIONS

"An Introduction to Textile Printing", p. 5, Pub. 1964, Pub. by Butterworths, London, Eng.

Peters, "Textile Chemistry", Elsewier Pub. Co., 1975 pp. 744–751.

Schmedlin Preparation & Dyeing of Synthetic Fibres, pp. 150–159, 1963, Chapman & Hall Ltd.

Jour. Soc. Dyes & Colorists May 1952, abstract of Dingler British Pat. No. 667,210.

*Primary Examiner*—Paul R. Michl

*Attorney, Agent, or Firm*—Edward McC. Roberts

[57] ABSTRACT

The invention relates to a process for dyeing or printing textile material, wherein the textile material is first impregnated with a solution or dispersion containing a dyestuff and the impregnated textile material is then treated with the superheated vapor of organic solvents.

12 Claims, No Drawings

DYEING AND PRINTING PROCESSES

This is a continuation of application Ser. No. 402,244, filed Oct. 1, 1973 now abandoned, which is a continuation of Ser. No. 222,664, filed Feb. 1, 1972 now abandoned, which is a continuation of Ser. No. 819,964, filed Apr. 28, 1969 now abandoned.

It has already been proposed to dye hydrophobic fibres in a continuous process using vapours of non-flammable chlorinated aliphatic hydrocarbons for example trichloroethylene, perchloroethylene and 1,1,1-trichloroethane. However, both the rate at which polyethylene terephthalate fibres can be dyed with disperse dyestuffs and the degree to which the latter can be fixed on the fibres (with trichloroethylene) by the said process are lower than can be obtained in conventional dyeing processes, in an aqueous medium in the presence of a carrier or under high-temperature conditions so that the said process is unsuitable for producing deep shades (compare, for instance, D. A. Garret, The Continuous Dyeing of Secondary Cellulose Acetate, Cellulose Triacetate and Terylene Polyester Fibres by the Vapocol Process, Journal Soc. Dyers and Colorists, 1957, page 365 [volume 73]).

The present invention is based on the unexpected observation that deep shades can be produced on synthetic fibres, especially on polyester materials, when the material is impregnated with a dyestuff solution or dispersion and then treated with the superheated vapour of an organic solvent.

Accordingly, the present invention provides a process for dyeing or printing textile materials, especially materials based on synthetic fibres, wherein the textile material is first impregnated, or preferably padded or printed with a solution or dispersion containing at least one dyestuff and the impregnated, padded or printed textile material is then treated with the super-heated vapour of one or more than one organic solvent.

The textile material to be treated in accordance with the invention is mainly a fabric or suitable knitwear or carpet of any description made of fully synthetic fibres, for example acrylic or acrylonitrile fibres, polyacrylonitrile fibres or copolymers of acrylonitrile with other vinyl compounds, for example acrylic esters, acrylamides, vinyl pyridine, vinyl chloride or vinylidene chloride, copolymers of dicyanoethylene and vinyl acetate, and those consisting of acrylonitrile block polymers, fibres of polyurethanes, cellulose triacetate and cellulose 2½-acetate, polyamides, for example nylon 6, nylon 6.6, nylon 11, nylon 6.10 (prepared from hexamethylendiamine and sebacic acid) or nylon 6.6/6 (copolymer of hexamethylenediamine, adipic acid and ε-caprolactam) and more especially fibres of aromatic polyesters, for example those derived from terephthalic acid and ethylene glycol or 1,4-dimethylolcyclohexane, and copolymers of terephthalic and isophthalic acid and ethylene glycol.

The dyestuffs to be used in the present invention are preferably those of the well-known series of water-insoluble disperse dyestuffs defined in the Colour Index, for example monoazo and disazo, anthraquinone, napthoperinone, quinophthalone and methine dyestuffs, including the styryl, azamethine and azostyryl dyestuffs; metal complex dyestuffs of the azo and formazan series are also suitable. Other suitable types of dyestuffs may also be used.

The dyestuffs can be applied to the textile material either in the form of an aqueous dispersion or in the form of a solution in an organic solvent.

In the former case it is generally advantageous to convert the dyestuffs to be used into a dye preparation before the dyeing operation; such a dye preparation contains a dispersant, for example sulphite cellulose waste liquor, or a synthetic detergent or a combination of different wetting and dispersing agents and the finely dispersed dyestuff in such a form that when the dye preparation is diluted with water a fine dispersion is obtained. Such dye preparations can be manufactured in known manner, for example by grinding the dry or wet dyestuff with or without addition of a dispersant during the grinding operation. The aqueous dispersion may also contain a thickener, for example sodium alginate, tragacanth, carob bean flour and similar thickeners and protective colloids, especially when the dyestuff is applied by printing.

When the textile fabric is impregnated with a solution of an organic dyestuff in an organic solvent, the solvent used for padding or printing the textile material may be the same as the organic solvent used for fixing; in this case no problem of separation arises; an azeotropically boiling mixture may also be used. When two different solvents are chosen, it is advantageous either to use solvents which form two phases at least after cooling or which can be separated into a hydrophilic and a hydrophobic, practically anhydrous phase on addition of water, or which are easy to separate by distillation, if desired with formation of azeotropic mixtures, or the material is subjected to an intermediate drying after having been impregnated.

One advantage of this variant of the dyeing process of this invention over the use of an aqueous dispersion is that unconditioned dyestuffs can be used, whereas in the preparation of an aqueous liquour it is always necessary to use a conditioned dyestuff preparation to facilitate its dispersion in water.

Suitable solvents are, for example, the hydrophobic solvents immiscible or only partially miscible with water, for example acetophenone, cyclohexanol and benzyl alcohol; esters for example ethyl acetate, propyl acetate, or butyl acetate; hydrocarbons for example benzene, xylene or toluene, and halogenated hydrocarbons for example carbon tetrachloride, chloroform, methylene chloride, trichloroethylene, perchloroethylene, trichloroethane, tetrachloroethane, dibromoethylene or chlorobenzene.

Water-miscible hydrophilic solvents constitute an especially preferred group of solvents, for example aliphatic alcohols for example methanol, ethanol, n-propanol or isopropanol; ketones for example acetone, methylethylketone or cyclohexanone; ethers and acetals for example diisopropyl ether, diphenylene oxide, dioxan, tetrahydrofuran, glycerolformal and glycolformal, acetonitrile, diaza-2,2,2-bicyclooctane, pyridine, diacetone alcohol; high-boiling glycol derivatives for example ethylene glycol monomethyl, monoethyl and monobutyl ethers and diethylene-glycol monomethyl or monoethyl ether, thiodiglycol, polyethylene glycols that are liquid at room temperature, ethylene carbonate, γ-butyrolactone and especially the group of water-miscible active solvents boiling above 120° C., for example N,N-dimethylformamide, N,N-dimethylacetamide, bis(-dimethylamido)-methanephosphate, tris-(dimethylamido)-phosphate, N-methylpyrrolidone, 1,5-dimethylpyrrolidone, N,N-dimethyl-methoxyacetamide, N,N,N',N'-tetramethylurea, tetramethylenesulphone (sulpholan), 3-methylsulpholan and dimethylsulphoxide.

Among the hydrophilic solvents to be used in the present process three subgroups are preferred, namely (1) those which are suitable for dissolving linear, spinnable fully synthetic polymers or polycondensates, for example acrylonitrile polymers, (2) the group of solvents that are miscible with water in all proportions and (3) the group of solvents that are free from hydroxyl groups.

Specially preferred are mixtures of chlorinated aliphatic hydrocarbons with up to 50% of a hydrophilic solvent, especially an amide of a lower fatty acid, for example dimethylacetamide or dimethylformamide.

Padding or printing in an organic medium is preferably carried out in the absence of dispersants, as a result of which the dyed textile material is easier to clean. If desired, a tenside may also be added to the dyeing or padding liquor. When a thickener is used, as is the case for instance in printing, a preferred thickener is a cellulose ether or ester having a high limiting viscosity, that is to say a high thickening effect per unit weight.

The impregnation on the padder is carried out either at room temperature or with heating. After the fabric has been conveyed through the dyestuff dispersion or solution it is pressed so that it retains the desired content of impregnating solution which is about 50 to 130% by weight referred to the weight of the dry fibres.

After leaving the padder or the printing machine the padded or printed material can, if desired, be freed from most of the adhering dyestuff dispersion or solution either by a short drying process, for example in a current of warm air heated to 30° to 90° C., or in another way, for example by centrifuging or it may be fixed as it is.

Fixing according to this invention is carried out by treatment with unsaturated solvent vapour in a chamber which contains the textile material and which is either adequately insulated or preferably additionally heated, for example by means of a steam jacket. The chamber may be in communication with the ambient atmosphere through a reflux condenser, in which case it is advantageous to return the condensed solvent directly into the vapour generator.

In addition to the above-mentioned organic solvents the following solvents may be specially mentioned: Acetylacetone, xylene, ethylbenzene, 2-ethoxyethanol, ethylbutylketone, amylmethylketone, dibutyl ether, n-butanol, n-butyl acetate, butylmethylketone, 2-methoxyethanol, cyclohexanol, toluene, formic acid, acetic acid, propionic acid, chlorobenzene, tetrachloroethylene, 1,2-dichloro ether and 1-chloro-2,3-epoxypropane.

Fixing is carried out at a temperature of from at least 80° to 200° C., especially 110° to 180° C. The duration of the fixing operation depends on the rate at which the absorption of dyestuff reaches a state of equilibrium, which as a rule does not take longer than 30 to 120 seconds. During the fixation it must be ensured that the solvent vapour does not condense.

The optimal fixing conditions that exclude damage to the fibre can be determined by a simple preliminary experiment.

Unless otherwise indicated, parts and percentages in the following Examples are by weight.

EXAMPLE 1

10 Parts of the dyestuff (Example 1 of British Pat. No. 917,258, published Jan. 30, 1963).

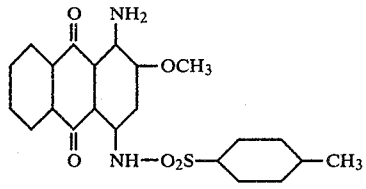

3 parts of a condensate of naphthalene-2-sulphonic acid and formaldehyde, and 37 parts of water are ground in a ball mill to form a fine dough. Then 20 parts of the resulting dough are dispersed in 400 parts of a 1% sodium alginate solution and 600 parts of water.

A fabric of polyethylene terephthalate is padded with the cold padding liquor thus prepared, squeezed to a weight increase of 65% and then dried for one minute at 120° C.

The dyestuff is then fixed in a chamber maintained at a constant temperature, the chamber being equipped with an external jacket containing heating liquid. The treatment was carried out for one minute at 156° C. with superheated acetyl-acetone vapour. After soaping and washing, the fabric is dyed a brilliant, uniform pink shade.

The amount of dyestuff on the fabric after padding (I) and after soaping (II) can be determined colorimetrically after extraction with chlorobenzene (cf. K. V. Datye, P. J. Kangle and B. Milicevic, Textilveredlung, volume 2, page 263 [1967]). This determination gave the following amounts of dyestuff in grammes per kilogram of fabric:

I=13.46

II=11.27 that is to say, a fixing degree of 84% is obtained.

EXAMPLE 2

The same polyester fabric as used in Example 1 is padded with a cold solution of 40 parts of the dyestuff (Example 8 of German Pat. No. 636,952, published Oct. 1, 1936) of the formula

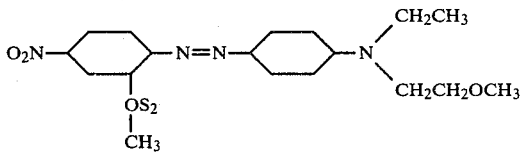

in 1000 parts of a mixture of propylene glycol and 2-ethoxyethanol (1:4 v/v), squeezed to a weight increase of 60%, dried in a current of air heated to 40° to 50° C. and then fixed for one minute at 161° C. in superheated propionic acid vapour. After soaping and washing a fast violet dyeing is obtained. Determination of the amounts of dyestuff as described in Example 1:

I=9.47 g of dyestuff per kg

II=8.76 g/kg, i.e. a fixing degree of 95%

EXAMPLE 3

A polyester fabric is padded with the dyestuff (Example 2 of British Pat. No. 882,533) of the formula

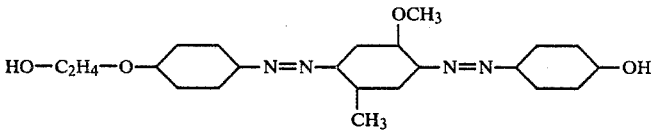

as described in Example 2 and then dried. The absorption of dyestuff I (see Example 1) was 13 g/kg. Fixing is carried out for one minute with saturated vapour and superheated vapour respectively. The following degrees of fixing are obtained:

| Fixing vapour used | Temperature in °C. saturated vapour | Temperature in °C. superheated vapour | Fixing degree saturated vapour | Fixing degree superheated vapour |
|---|---|---|---|---|
| ethylbenzene | 138 | 161 | 27% | 53% |
| propionic acid | 141 | 161 | 15% | 74% |
| acetylacetone | 139 | 161 | 7% | 85% |
| ethylbutylketone | 147 | 161 | 15% | 79% |
| xylene | 140 | 161 | 34% | 58% |
| 2-ethoxyethanol | 135 | 161 | 31% | 65% |
| tetrachloro-ethylene | 122 | 161 | 8% | 60% |

The table shows the unexpected increase in the degree of fixing when superheated instead of saturated vapour is used. When, however, the treatment is carried out with trichloroethylene vapour at 87° C., the fixing degree obtained is only 2.5%.

EXAMPLE 4

The vapours of azeotropic mixtures may also be used as the fixing medium. The fabric of Example 3 is impregnated with dyestuff, dried and then treated for one minute with the azeotropic vapours of the mixtures indicated:

| Fixing vapour | Temperature °C. | Fixing degree |
|---|---|---|
| dimethylformamide (18.7%) + xylene (81.3%) | 136 | 60% |
| tetrachloroethane (32%) + formic acid (68%) | 103 | 68% |
| chlorobenzene (82%) + propionic acid (18%) | 130 | 34% |

EXAMPLE 5

100 Parts of a polyamide (nylon) fabric are padded with a solution of 16 parts of the dyestuff (synthesized according to Example 1 of British Pat. No. 885,814, published Dec. 28, 1961) of the formula

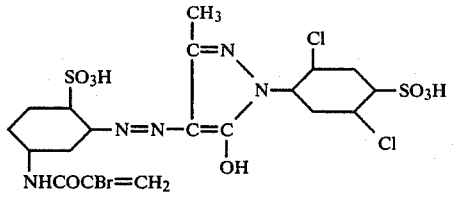

and 40 parts of ammonium acetate in 1000 parts v/v of water, squeezed to a weight increase of 75% and dried for one minute in a current of air heated to 100° C. The fabric is then treated for one minute at 116° C. with superheated n-propanol vapour. The treated fabric is dyed a deep yellow shade.

When only 2 instead of 16 parts of the dyestuff are used, a faint yellow dyeing results. Both dyeings are level.

EXAMPLE 6

A nylon fabric is impregnated in a similar manner with the dyestuff (Example 2 of British Pat. No. 1,166,913, published Oct. 15, 1969 and equivalent to French Pat. No. 1,510,582, published Dec. 11, 1967) of the formula

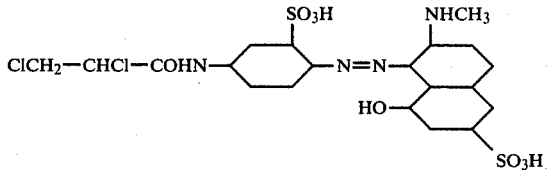

The dried fabric is treated for one minute with the superheated vapour of 2-ethoxyethanol at 153° C. The finished fabric has a reddish dark-blue shade.

When only 2 parts of the dyestuff are used, a faintly reddish blue dyeing results. Both fabrics are dyed a level shade.

EXAMPLE 7

100 Parts of nylon fabric are padded with a dispersion of 16 parts of the dyestuff (synthesized according to Colour Index 11215) of the formula

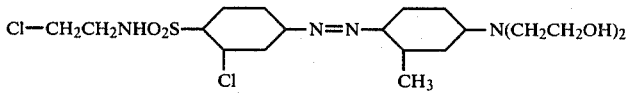

and 20 parts of sodium carbonate in 1000 parts of water, squeezed to a weight increase of 75%, dried for one minute in warm air at 100° C. and fixed for one minute at 153° C. with the superheated vapour of 2-ethoxyethanol. The fabric thus treated has a deep scarlet shade.

When only 2 parts of the above dyestuff are used, a weaker scarlet dyeing results. Both dyeings are level.

EXAMPLE 8

100 Parts of a nylon fabric are padded with a solution of 50 parts of the 1:2-chromium complex of the dyestuff (synthesized according to Example 1 of British Pat. No. 724,157, published Feb. 16, 1955) of the formula

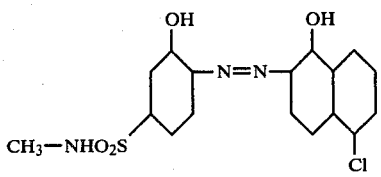

in 1000 parts of water, squeezed to a weight increase of 75% and dried for one minute in a current of air at 100° C. The dyeing is then fixed for one minute at 153° C. in superheated acetylacetone vapour. The fabric thus treated has a dark blue shade.

When only 2 parts of the above dyestuff are used, a weak blue dyeing results. Both dyeings are level.

EXAMPLE 9

100 Parts of nylon fabric are padded with a dispersion of 16 parts of the dyestuff (Colour Index 62015) of the formula

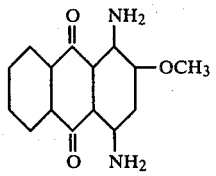

in 1000 parts of water, squeezed to a weight increase of 75% and dried for one minute at 100° C. in a current of warm air. The dyeing is fixed for one minute at 153° C. with superheated acetyl-acetone vapour. The treated fabric has a dark pink shade.

When only 2 parts of the above dyestuff are used, a weak pink dyeing results. Both dyeings are level.

EXAMPLE 10

100 Parts of nylon fabric are padded with a solution of 33 parts of the dyestuff (synthesized according to Colour Index 17070) of the formula

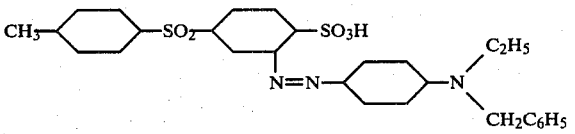

in 1000 parts of water, squeezed to a weight increase of 75% and dried for one minute in a current of air heated to 100° C. The dyeing is then fixed for 60 seconds at 153° C. with superheated acetyl-acetone vapour.

When only 2 g per liter of the dyestuff mentioned above are used, a weak orange dyeing results. Both dyeings are level.

EXAMPLE 11

100 Parts of polyacrylonitrile (Orlon) fabric are padded with a solution of 66 parts of the dyestuff (Colour Index 51004) of the formula

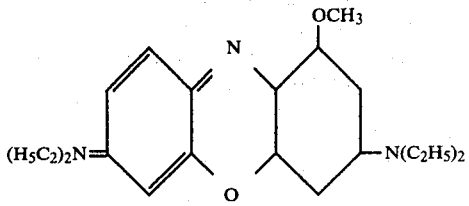

in 1000 parts v/v of water, squeezed to a weight increase of 75% and dried for one minute in a stream of warm air at 100° C. The fabric is then fixed for 1 minute at 153° C. with superheated acetylacetone vapour. A blue fabric is obtained.

I claim:

1. A process for dyeing or printing textile material which consists essentially of first impregnating the textile material with a solution or dispersion of a dyestuff, subsequently air-drying said impregnated textile material, and thereafter fixing the dye by exposing said textile material, at atmospheric pressure, to the superheated vapor of at least one organic solvent, the fixing being performed at a temperature of from 80° to 200° C. without condensation of the solvent vapors.

2. The process of claim 1, wherein the textile material is synthetic hydrophobic fibers.

3. The process of claim 1, wherein the textile material is impregnated by padding or printing.

4. The process of claim 3, wherein the textile material is polyester acrylic or nylon material.

5. The process of claim 1, wherein the superheated vapour of one or more of the following solvents is used: acetylacetone, xylene, ethylbenzene, 2-ethoxyethanol, ethyl butyl ketone, amyl methyl ketone, dibutyl ether, n-butanol n-butyl acetate, butyl methyl ketone, 2-methoxyethanol, cyclohexanol, toluene, formic acid, acetic acid, propionic acid, chlorobenzene, tetrachloroethylene, 1,2-dichloroethane or 1-chloro-2,3-epoxypropane.

6. The process of claim 1, wherein the organic solvent is tetrachloroethylene.

7. The process of claim 5, wherein the superheated vapour is an azeotrophic mixture.

8. The process of claim 1, wherein the textile material is impregnated with an aqueous dispersion of at least one dyestuff.

9. The process of claim 3, wherein the dyestuff is a disperse dyestuff.

10. The process of claim 4, wherein the organic solvent is a mixture of a chlorinated aliphatic hydrocarbon and up to 50% of a hydrophilic solvent.

11. The process of claim 4, wherein the textile material is nylon and the dyestuff is an acid dyestuff or a disperse dyestuff.

12. The process of claim 4, wherein the textile material is acrylic and the dyestuff is a quaternary dyestuff.

* * * * *